US005277253A

United States Patent [19]

Giroux et al.

[11] Patent Number: 5,277,253

[45] Date of Patent: Jan. 11, 1994

[54] HYDRAULIC SET CASING PACKER

[75] Inventors: Richard L. Giroux; Alan B. Duell, both of Duncan, Okla.; Anthony M. Badalamenti, New Orleans, La.

[73] Assignee: Halliburton Company, Duncan, Okla.

[21] Appl. No.: 862,807

[22] Filed: Apr. 3, 1992

[51] Int. Cl.[5] ..... E21B 33/127

[52] U.S. Cl. ..... 166/187; 166/192

[58] Field of Search ..... 166/387, 155, 179, 182, 166/185, 186, 187, 192, 242

[56] References Cited

U.S. PATENT DOCUMENTS

| | | | |
|---|---|---|---|
| 3,027,944 | 4/1962 | Feeser | 166/187 |
| 3,215,205 | 11/1965 | Sizer | 166/187 |
| 3,524,503 | 8/1970 | Baker | 166/289 |
| 3,587,736 | 6/1971 | Brown | 166/187 |
| 3,948,322 | 4/1976 | Baker | 166/289 |
| 4,403,660 | 9/1983 | Coone | 166/179 X |
| 4,421,165 | 12/1983 | Szarka | 166/151 |
| 4,744,421 | 5/1988 | Wood et al. | 166/387 |
| 4,791,992 | 12/1988 | Greenlee et al. | 166/187 X |
| 4,834,184 | 5/1989 | Streich et al. | 166/376 |
| 4,962,812 | 10/1990 | Berzin | 166/187 |
| 5,046,557 | 9/1991 | Manderscheid | 166/179 X |

FOREIGN PATENT DOCUMENTS

| | | | |
|---|---|---|---|
| 1395802 | 5/1988 | U.S.S.R. | 166/179 |

OTHER PUBLICATIONS

Exhibit A—Drawing.
Exhibit B—Drawing.
Exhibit C—Brochure of Tam International of Houston, Texas.
Exhibit D—Halliburton Services Sales & Service Catalog No. 43, p. 2438 (1985).

*Primary Examiner*—Terry Lee Melius
*Attorney, Agent, or Firm*—James R. Duzan; Lucian W. Beavers

[57] ABSTRACT

A casing packer apparatus includes a mandrel having a mandrel exterior, a longitudinal mandrel bore defined therethrough, and a power port defined in the mandrel communicating the mandrel bore with the mandrel exterior. A packer element is concentrically received about the mandrel. An annular piston is concentrically received about the mandrel and has an annular differential pressure area defined thereon and communicated with the mandrel bore through the power port. The annular piston and packer element are operably associated so that the packer element is set by sliding motion of the piston in response to increased fluid pressure in the mandrel bore. Either a compression set packer element or an inflatable packer element may be utilized.

19 Claims, 3 Drawing Sheets

HYDRAULIC SET CASING PACKER

BACKGROUND OF THE INVENTION

1. Field Of The Invention

The present invention relates generally to casing packers for use in packing an annulus surrounding a string of casing in a well.

2. Description Of The Prior Art

During the construction of an oil or gas well, a casing string is typically placed within the bore hole and cemented in place in the bore hole. This cementing is often performed in multiple stages. It is often desirable to pack off an annulus surrounding a string of casing. This annulus may either be between the casing string and the bore hole, or between two stages of the casing string, with the lower stage being of smaller diameter than an upper stage.

The packers utilized to perform this task may either be individual casing packers which do not have any cementing valve mechanisms associated therewith, or they may be an integral part of a multi-stage cementing tool which includes both a cementing valve apparatus and a packer apparatus which operate in conjunction with each other.

Examples of such multiple stage cementing tools including inflatable packers include U.S. Pat. No. 4,421,165 to Szarka, U.S. Pat. No. 3,948,322 to Baker, and U.S. Pat. No. 3,524,503 to Baker, all assigned to the assignee of the present invention. Such multiple stage cementing tools are also available with compression set packer elements rather than inflatable packer elements.

The present invention is directed to improvements in individual casing packers, i.e., that is casing packers which are not part of a multi-stage cementing tool and which do not have cementing valve apparatus associated therewith as an integral part of the casing packer apparatus. There may of course be other tools in the casing string which may be other casing packers, individual cementing tools, or multi-stage cementing tools. The present invention, however, is directed to an individual casing packer which operates independently of the operation of such other tools which may be present in the string.

With regard to individual casing packers, there are a number of such tools included in the prior art. One such tool marketed by the assignee of the present invention, Halliburton Company, is known as a Halliburton DV Cementing Collar Assembly. This device includes a mechanical compression set packer which is set after a plug is landed on an annular seat within the tool bore and hydraulic pressure is then applied on top of the plug to slide downward an internal sleeve which is connected to an external sleeve which actually compresses the packer element.

The disadvantage of the existing mechanically operated casing packers is that typically they do not have a full opening therethrough because an annular landing surface must be provided for receipt of a plug completely closing the inner bore of the tool in order to operate the tool. Also, removal of the plug may later be necessary after operation of the tool.

Another type of cementing packer which is presently available is an inflatable packer which utilizes a system of spool valves and check valves to control the flow of high pressure fluid into an inflatable packer element. Examples of this type of casing packer include the Halliburton Casing Inflation Packer available from Halliburton Company of Duncan, Okla., and the Tamcap TM Inflatable Cementing Packers available from Tam International of Houston, Tex.

The difficulty encountered with existing inflatable casing packers is due to the complex spool valve and check valve mechanisms which are necessary to control the flow of fluid to the inflatable packer.

Thus, there is a need for a simplified design for casing packers which provides increased economy of construction and improved reliability while eliminating the disadvantages mentioned above.

SUMMARY OF THE INVENTION

A casing packer apparatus for use in a casing string in a well includes a mandrel having a mandrel exterior, a longitudinal mandrel bore defined therethrough, and a power port defined in the mandrel communicating the mandrel bore with the mandrel exterior.

A packer element is concentrically received about the mandrel. Alternative embodiments of the invention provide either a compression set type packer element or an inflatable packer element.

An annular piston is concentrically received about the mandrel and has an annular differential pressure area defined thereon which is communicated with the mandrel bore through the power port. The annular piston and packer element are operably associated so that the packer element is set by sliding motion of the piston in response to increased fluid pressure in the mandrel bore.

In the embodiment utilizing a compression set packer element, the annular piston bears directly against the packer element to longitudinally compress it. In the embodiment utilizing an inflatable packer element, the annular piston displaces an inflation fluid which inflates the packer element.

A releasable retaining device is provided for preventing movement of the piston relative to the mandrel until a differential pressure acting across the differential pressure area of the piston reaches a preset level. The operation of the casing packer is completely independent of any cementing valves or other tools which may be present in the casing string.

Numerous objects, features and advantages of the present invention will be readily apparent to those skilled in the art upon reviewing the following disclosure when taken in conjunction with the accompanying drawings.

DETAILED DESCRIPTION OF THE PREFERRED EMBODIMENTS

Figure 1:
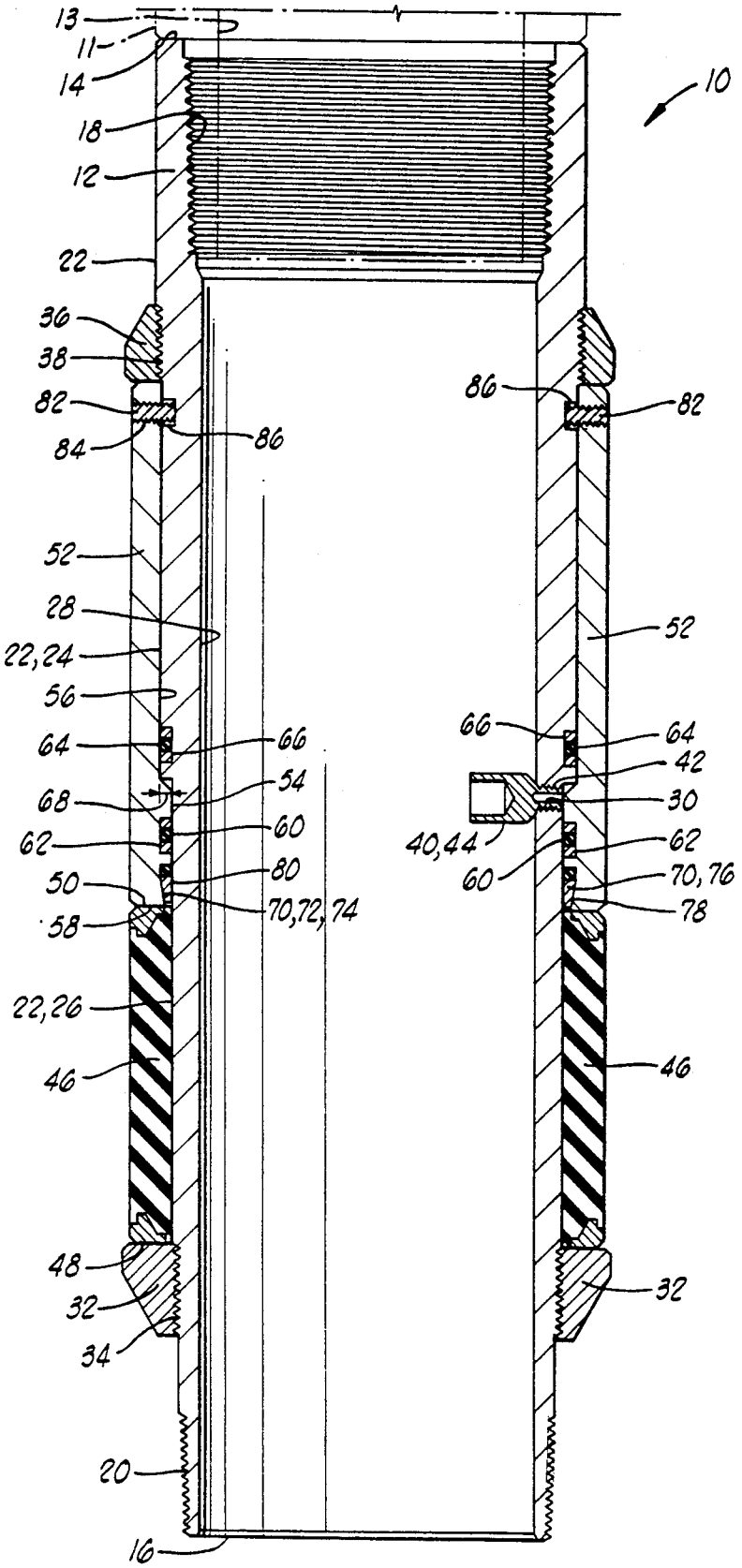
FIG. 1 is an elevation sectioned view of a first embodiment of the casing packer having a compression set packer element.

The Embodiment Of FIG. 1

In FIG. 1, a casing packer apparatus is shown and generally designated by the numeral 10. The casing packer 10 includes a one-piece mandrel 12 having upper and lower ends 14 and 16. The upper end 14 carries an internal female thread 18 for connection thereof to a portion of the casing string 11 located thereabove. The lower end 16 carries an external male thread 20 for connection thereof to a portion of the casing string located therebelow. The one-piece mandrel 12 has no welds or threaded connections which structurally carry the weight of the casing string suspended therebelow, and thus the one-piece mandrel 12 can be built to match or exceed the strength of the casing to which it is connected.

The mandrel 12 has an exterior 22 including a larger diameter cylindrical outer surface portion 24 and a smaller diameter cylindrical outer surface portion 26.

The mandrel 12 has a cylindrical inner mandrel bore 28 defined therethrough from its upper end 14 to its lower end 16. Mandrel bore 28 communicates with a casing bore 13 of casing string 11. One or more power ports 30 are defined radially through the mandrel 12 for communicating the mandrel bore 28 with the mandrel exterior 22.

A lower or first fixed shoe 32 is attached to mandrel 12 at threaded connection 34. An upper or second fixed shoe 36 is attached to mandrel 12 at threaded connection 38. The second fixed shoe 36 can be described as being located on a side of the piston 52 opposite from the first fixed shoe 32.

The power port 30 is temporarily blocked by a frangible break-off plug 40 which has a hollow inner portion 42 which is threadedly engaged with power port 30, and which has a break-off portion 44 which extends radially into the mandrel bore 28. The break-off plug 40 prevents premature actuation of the casing packer 10 due to pressure surges, and it also prevents contaminating materials from entering the power port 30. The break-off portion 44 of break-off plug 40 will be sheared off when the first cementing plug is pumped downward through the casing string thus opening the power port 30 so that the casing packer apparatus 10 is ready for operation. The break-off plug 40 can, however, be eliminated and the casing packer apparatus 10 can be operated without such a break-off plug.

A compression set packer element 46 is received about the smaller diameter cylindrical outer surface portion 26 of mandrel 12. Packer element 46 has first and second ends 48 and 50. The first end 48 abuts the lower fixed shoe 32.

An annular piston 52 is concentrically received about the mandrel 12. Piston 52 includes a piston bore 54 and a piston counterbore 56 which are closely received about the smaller diameter cylindrical outer surface portion 26 and the larger diameter cylindrical outer surface portion 24, respectively, of mandrel 12. The piston 52 may be referred to as a stepped piston 52.

The piston 52 has a lower end 58 which abuts the upper or second end 50 of compressible packer element 46. A radially inner O-ring seal 60 is received in a groove 62 defined in the piston bore 54 and seals against the cylindrical outer surface portion 26 of mandrel 12. A radially outer O-ring seal 64 is received in a groove 66 defined in the larger diameter cylindrical outer surface portion 24 of mandrel 12 and seals against the piston counterbore 56. The power port 30 communicates with the mandrel exterior 22 between the inner and outer seals 60 and 64. Each of the seals 60 and 64 includes full backups on each side of the O-ring.

An annular differential pressure area 68 is defined on piston 52 between the inner and outer seals 60 and 64. This annular differential pressure area 68 is located entirely outside of the inner bore 28 of mandrel 12 and is communicated with the mandrel bore 28 through the power port 30. The annular differential pressure area 68 can also be described as being defined between the piston bore 54 and piston counterbore 56.

The piston 52 carries at its lower end a locking means generally designated by the numeral 70 for locking the piston 52 in an actuated position after the packer element 46 is set. The locking means 70 includes a radially inner groove 72 defined in the piston 52 and partially defined by an annular tapered groove surface 74 which tapers radially inwardly as it progresses toward the packer element 46. The tapered groove surface 74 can also be described as being tapered radially inwardly in a direction of actuating motion of the piston 52, i.e., in a downward direction in the embodiment of FIG. 1. The locking means 70 further includes a wedge lock ring 76 received in groove 72 and having a tapered ring surface 78 complementary to and engaging tapered groove surface 74 so that longitudinal expansion of the packer element 46 after setting of the packer element 46 is opposed due to the fact that the engaged tapered groove surface 74 and tapered ring surface 78 cam the wedge lock ring 76 radially inwardly against the cylindrical outer surface 26 of mandrel 12.

The wedge lock ring 76 is an annular ring which has a radially split (not shown) therein so that it can radially contract and expand. The wedge lock ring 76 has a serrated radially inner surface 80 to aid the ring 76 in tightly gripping the outer surface 26 of mandrel 12.

A plurality of externally accessible shear pins 82 connect the piston 52 to the mandrel 12. The shear pins 82 are threadedly received in radial bores 84 extending through piston 52 and in an annular groove 86 formed in the cylindrical outer surface 24 of mandrel 12. The externally accessible shear pins allow the operator to easily select the correct setting pressure for the packer on location in the field. This is accomplished by selecting the number of shear pins to be placed in the packer.

The shear pins 82 may be generally referred to as a releasable retaining means 82 for preventing movement of the piston 52 relative to mandrel 12 until a differential pressure acting downward across differential pressure area 68 of piston 52 reaches a preset level determined by the shear pins 82. The releasable retaining means 82 controls operation of the piston 52 independently of any cementing valves or other tools which may also be present in the casing string.

It is noted that the lower and upper fixed shoes 32 and 36 each have outside diameters slightly greater than the outside diameter of piston 52 so that if the apparatus 10 is placed against the side wall of a well bore or a previously placed casing string, the piston 52 will be held slightly off that wall so that it may still operate in its intended manner.

The operation of the apparatus 10 is generally as follows. The apparatus 10 is made up in a casing string and is lowered into a well. After the casing string is in place, the break-off plug 40, if it is used, will be sheared off by pumping a cementing plug down through the casing bore and thus through the mandrel bore 28. This will open the power port 30. If the break-off plug 40 is not utilized, the power port 30 will always be open.

When it is desired to set the packing element 46, fluid pressure within the casing bore and thus within the mandrel bore 28 is increased to a preset level determined by the shear pins 82. That increased fluid pressure will act downwardly across the differential pressure area 68 until the downward force exerted on piston 52 is sufficient to shear the shear pins 82, at which time the shear pins 82 will shear and the piston 52 will move downward thus longitudinally compressing the packing element 46 and causing the packing element 46 to expand radially outward to seal against the surrounding well bore or casing bore. The piston 52 can only be activated by internal pressure and it is not activated by pumping a cementing plug down against an actuating collar. When the packing element 46 has expanded to the fullest extent possible, the piston 52 is in what is referred to as an actuated position. The locking means 70 will prevent the piston 52 from moving back upward and thus will lock the packing element 46 in its set position.

The most common use for the casing packer 10 is to run it on a string of casing which is run inside a previously run larger casing string. The casing packer 10 is set near the bottom of the previously run larger casing string to prevent gas migration between the two casing strings. The casing packer 10 may also be utilized, however, with a casing string where the packer is to be set in an open bore hole to help support a cement column thereabove or to prevent fluid flow into the cement from below. Multiple numbers of individual casing packers such as casing packer 10 may be run in the same casing string and each one may be adjusted to activate at a different pressure by selecting a different number of shear pins. Thus multiple casing packers 10 may be run for example on a staged cementing job.

The operation of the casing packer 10 is sharply contrasted to that of casing packers which are incorporated in multi-stage cementing tools in that the casing packer 10 operates completely independently of the operation of any cementing valves of the type which are included in multi-stage cementing tools. In multi-stage cementing tools, the casing packer operation is dependent upon and operates only in a specified predetermined relationship to the operation of a cementing valve incorporated in the multi-stage cementing tool.

Figure 2:
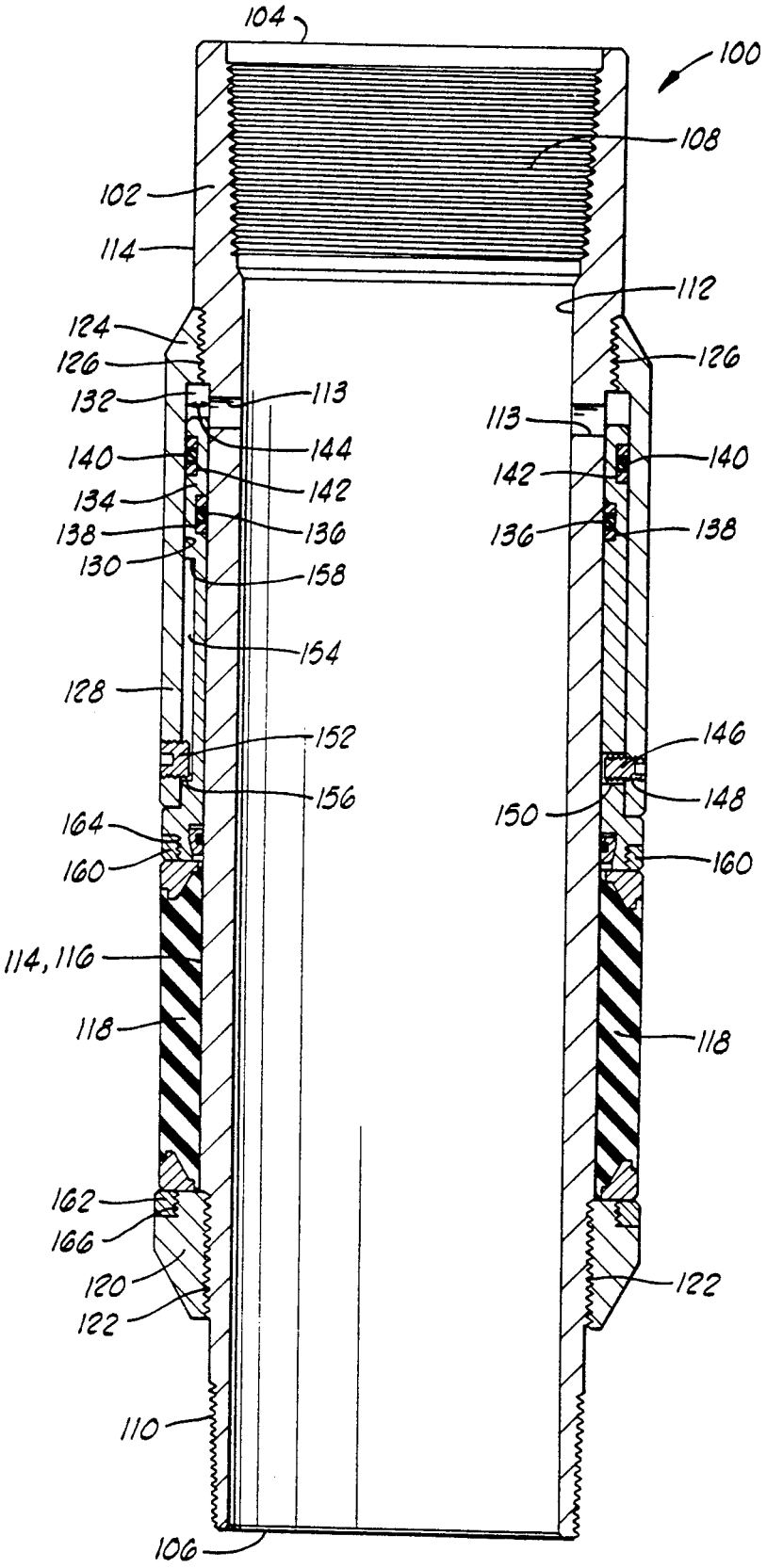
FIG. 2 is an elevation sectioned view of a second embodiment of the casing packer having a compression set packer element.

The Embodiment Of FIG. 2

In FIG. 2, a second embodiment of the casing packer apparatus is shown and generally designated by the numeral 100. The apparatus 100 differs from the apparatus 10 primarily in the construction of the piston which compresses the compression set packer element.

Casing packer 100 includes mandrel 102 having upper and lower ends 104 and 106 carrying female threads 108 and male threads 110, respectively. Mandrel 102 has a mandrel bore 112. Mandrel 102 has a mandrel exterior 114 which includes a cylindrical outer surface portion 116. Power ports 113 communicate mandrel bore 112 with mandrel exterior 114. A compression set packer element 118 is received about cylindrical outer surface portion 116.

A lower fixed shoe 120 is attached to mandrel 102 at thread 122. The lower end of packer element 118 abuts the upper end of fixed shoe 120.

A fixed upper shoe 124 is attached to mandrel 102 at thread 126. A cylindrical outer sleeve or skirt 128 is integrally formed with upper fixed shoe 124 and extends downwardly therefrom. Sleeve 128 is concentrically received about the cylindrical outer surface 116 of mandrel 102. Sleeve 128 has an inner sleeve bore 130 spaced radially outward from cylindrical outer surface portion 116 of mandrel 102 and thus defining an annular space 132 therebetween.

An annular piston 134 is received in the annular space 132. A radially inner seal 136 is received in a radially inner groove 138 of annular piston 134 and moves longitudinally with the piston 134. Seal 136 seals against the cylindrical outer surface portion 116 of mandrel 102.

A radially outer seal 140 is received in a radially outer groove 142 of annular piston 134 and also moves longitudinally with piston 134. Outer seal 140 seals against sleeve bore 130. The power ports 113 communicate with the annular space 132 above the seals 136 and 140.

The piston 134 has an annular differential pressure area 144 defined thereon which can be described as being defined between inner and outer seals 136 and 140 or as being defined between outer cylindrical surface 116 of mandrel 102 and sleeve bore 130 of sleeve 128.

As seen in the right-hand side of FIG. 2, a plurality of externally accessible shear pins 146 initially hold the piston 134 in place relative to mandrel 102 and sleeve 128. The shear pins 146 are threadably received through radial bores 148 through sleeve 128 and in bores 150 defined in the piston 134.

The power ports 113 of casing valve apparatus 100 are shown as being always open, and as not utilizing a break-off plug like break-off plug 40 of FIG. 1. It will be understood, however, that a break-off plug like break-off plug 40 could be utilized in the power ports 113.

The casing valve apparatus 100 illustrates two additional optional features.

The first additional feature is the provision of a limit pin 152 which is fixedly attached to sleeve 128 and thus to mandrel 102 and which is received in a longitudinal groove 154 defined in piston 134. The groove 154 has first and second ends 156 and 158, respectively, which are closer to and further away from the packer element 118, respectively. The limit pin 152 functions to limit downward movement of piston 134 when the pin 152 abuts the upper end 158 of groove 154. This prevents the piston 134 from being pumped completely downward out of the annular space 132 if excessive fluid pressures are applied to the casing bore.

The second optional feature illustrated in FIG. 2 is the use of adjustable upper and lower shoes 160 and 162 associated with the compressible packing element 118. The adjustable upper shoe 160 is an annular ring threadedly connected to the lower end of piston 134 at thread 164. The adjustable lower shoe 162 is an annular ring which is threadedly connected to fixed lower shoe 120 at thread 166.

As will be appreciated by those skilled in the art, it is sometimes desirable to replace the packing element 118 with an element of greater or smaller outside diameter so as to accommodate different sizes of casing. When this is done, it is desirable to replace the adjustable upper and lower shoes 160 and 162 with rings having an outside diameter at least as great as that of the packing element 118 which is to be utilized. The adjustable shoes 160 and 162 allow the packer element to be changed in the field to meet local conditions.

A limit pin arrangement similar to the limit pin 152 and the adjustable shoes such as 160 and 162 may also be utilized with the casing valve apparatus 10 of FIG. 1.

Figure 3:
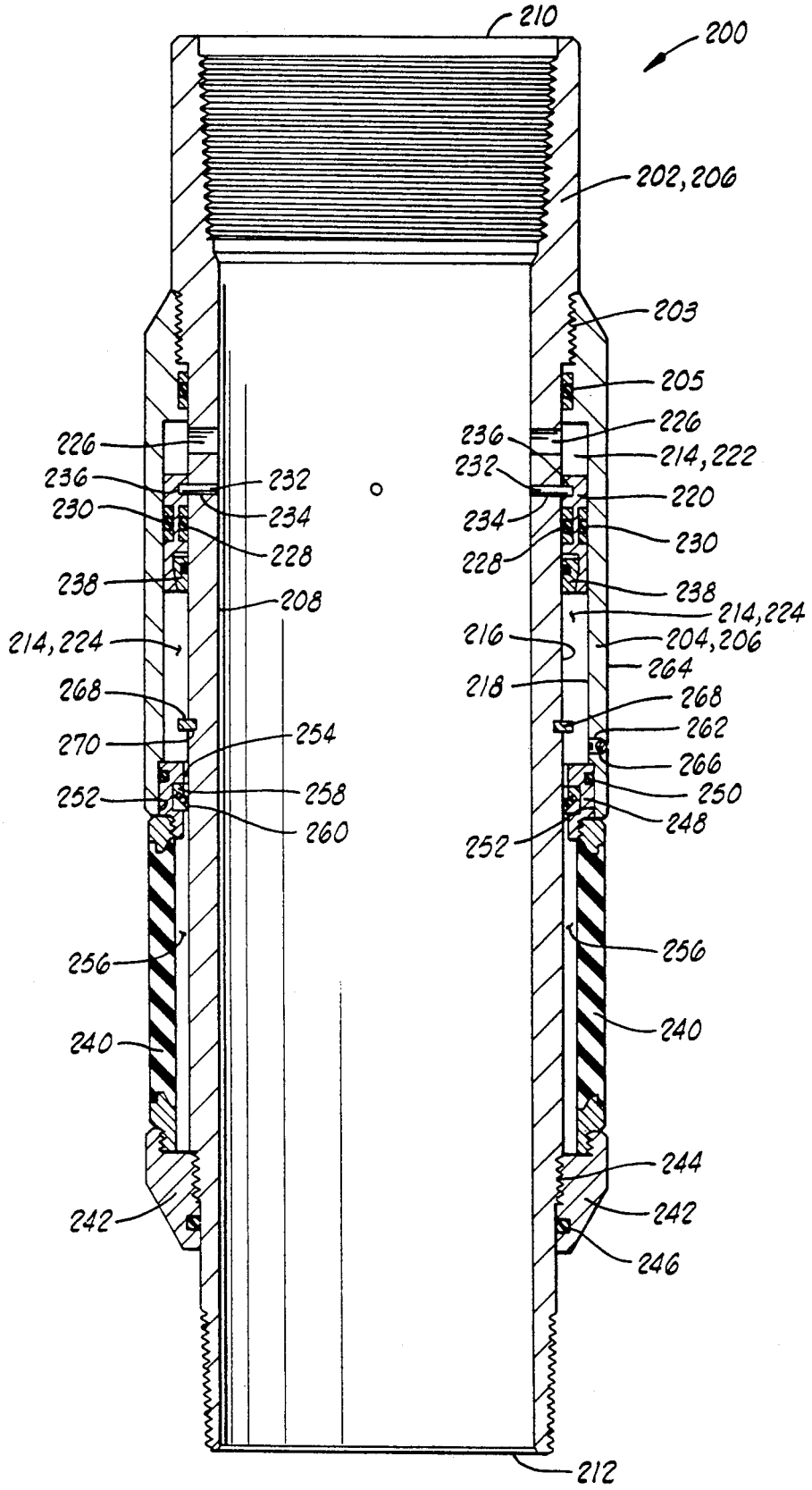
FIG. 3 is an elevation sectioned view of a third embodiment of the casing packer having an inflatable packer element.

The Embodiment Of FIG. 3

In FIG. 3, a third embodiment of the casing packer apparatus is shown and generally designated by the numeral 200. The casing packer apparatus 200 differs from the apparatus 10 and 100 of FIGS. 1 and 2 in that the casing packer apparatus 200 includes an inflatable packer element which is inflated by fluid displaced by the sliding piston.

The casing packer apparatus 200 includes a mandrel 202 which may also be referred to as a case 202. An outer sleeve or cover 204 is attached to mandrel 202 at threaded connection 203 with an annular cover seal 205 being provided therebetween.

The mandrel 202 and cover 204 may be collectively referred to as a housing 206.

A mandrel bore 208, which may also be referred to as a longitudinal central housing bore 208 is defined through the mandrel 202 from its upper end 210 to its lower end 212.

An annular displacement chamber 214 is defined in the housing 206 between a cylindrical outer surface 216 of mandrel 202 and a cylindrical inner sleeve bore 218 of sleeve 204. An annular sliding piston 220 is received in displacement chamber 214 and divides the displacement chamber 214 into a housing side chamber portion 222 and a packer side chamber portion 224.

Power ports 226 are disposed through mandrel 202 and communicate the mandrel bore 208 with the housing side chamber portion 222.

Radially inner and outer seals 228 and 230, respectively, are carried by a piston 220 in grooves defined therein and sealingly engage the cylindrical outer surface 216 of mandrel 202 and the sleeve bore 218, respectively.

A plurality of internally adjustable shear pins 232 are disposed through shear pin bores 234 defined in mandrel 202 and received in an annular groove 236 defined in the radially inner surface of annular piston 220. The number of shear pins 232 can be selected when the apparatus 200 is assembled to determine the downward force required to begin movement of the piston 220 to set the casing packer apparatus 200.

The piston 220 carries a wedge lock ring type of locking means 238 which is constructed similarly to the locking means 70 described with regard to FIG. 1.

An inflatable packer element 240 is concentrically received about the mandrel 202 of housing 206. Packer element 240 includes a fixed bottom shoe 242 threadedly connected to mandrel 202 at 244 with an annular bottom shoe seal 246 provided therebetween.

The inflatable packer element 240 includes a sliding top shoe 248 which includes a top shoe seal 250 which slidingly sealingly engages a lower counterbore 252 defined in sleeve 204.

An annular fluid inlet 254 is defined between top shoe 248 and the cylindrical outer surface 216 of mandrel 202. Fluid inlet 254 communicates the packer side chamber portion 224 with an inflation chamber 256 within the inflatable packer element 240.

An annular fluid inlet check valve means 258 is received in the fluid inlet 254. Check valve means 258 includes an annular elastomeric wiper blade type of valve element 260 which is angled downward as shown in FIG. 3 and which allows fluid to flow from the packer side chamber portion 224 past valve element 260 into the inflation chamber 256 to inflate the inflatable packer element 240, while preventing fluid from escaping from the inflation chamber 256 back out through the fluid inlet 254.

The outer sleeve 204 has a supply fluid port 262 defined therein which communicates the packer side chamber portion 224 with an exterior 264 of housing 206 so that well fluid from outside of said housing 206 can enter said packer side chamber portion 224. A supply fluid check valve means 266 is operably associated with the supply fluid port 262 for allowing well fluid to flow from outside the housing 206 into the packer side chamber portion 224 and for preventing fluid from flowing from the packer side chamber portion 224 out through the supply fluid port 262.

An annular piston travel limit ring 268 is received in a groove 270 defined in the cylindrical outer surface 216 of mandrel 202 for limiting downward motion of the piston 220.

The manner of operation of the casing packer apparatus 200 is generally as follows. The apparatus 200 is provided in casing string 11 and is run into the well with the casing string. When it is desired to set the inflatable packer element 220, fluid pressure within the casing bore 13 is increased thereby increasing a pressure differential acting downwardly across piston 220 to an actuating level at which the shear pins 232 shear thus releasing the piston 220.

The piston 220 then begins to travel downwardly through displacement chamber 214 in response to the downward pressure differential acting thereacross. The downwardly moving piston 220 displaces fluid from packer side chamber portion 224 forcing it through the fluid inlet 254 past fluid inlet check valve 258 into the inflation chamber 256 thus inflating the inflatable packer element 240 to set the same against a surrounding casing bore or well bore.

The piston travel limit ring 268 will limit downward travel of piston 220. The locking means 238 will prevent the piston 220 from moving back upward.

The sliding top shoe 248 of inflatable packer element 240 can slide downward within sleeve counterbore 252 to accommodate the deformation of the inflatable packer element 240 as it inflates.

The fluid inlet check valve 258 allows inflation fluid to flow into the inflation chamber 256, but then prevents that fluid from escaping therefrom.

The supply fluid check valve means 266 serves several purposes. Initially it may allow the packer side chamber portion 224 to fill with well fluid a the apparatus 200 is placed in the well. It is noted, however, that preferably the packer side chamber portion 224 is initially filled with an incompressible fluid such as oil upon assembly of the apparatus 200 before running the same into the well. The supply fluid check valve 266 further serves to equalize pressure on both sides of the inflatable packer element 240 while running the same into the well.

Additionally, the supply fluid check valve means 266 provides an important safety feature in the event that pressure in the well surrounding the apparatus 200 subsequently increases to a level greater than the pressure of the inflation fluid contained within inflation chamber 256. If this occurs, the supply fluid check valve means 266 will allow additional well fluid to enter the supply fluid port 262 thus increasing the pressure within inflation chamber 256 so that it is maintained at least as great as the external surrounding pressure, thus helping avoid unintentional deflation of the inflatable packer element 240.

The radially inner and outer piston seals 228 and 230 are long-term seals which provide casing integrity so that there is no communication between the housing bore 208 and the exterior 264 of housing 202 in the event the inflatable packer element 240 ruptures or otherwise begins to leak.

The mandrel 202 and outer sleeve 204 of housing 206 are designed to withstand the same burst and collapse pressures as the casing string 11 into which they are connected.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A casing packet apparatus, comprising:

a one-piece mandrel having female threaded upper and male threaded lower ends for connection of said apparatus into a string of casing, said mandrel having an exterior including a cylindrical outer surface, said mandrel having a cylindrical inner bore, and said mandrel having a power port defined therein communicating said cylindrical inner bore with said exterior, said one piece mandrel providing a means for structurally carrying the weight of said string of casing therebelow without carrying said weight across any threaded or welded connections;

a fixed shoe attached to said exterior of said mandrel;

a compression set packet element received about said cylindrical outer surface of said mandrel and having first and second ends with said first end of said packer element abutting said fixed shoe;

an annular piston received about said cylindrical outer surface and abutting said second end of said packet element; and radially inner and outer seals associated with said piston and defining an annular differential pressure area on said piston between said inner and outer seals, said annular differential pressure area being located entirely outside of said inner bore of said mandrel and being communicated with said inner bore of said mandrel by said power port.

2. The apparatus of claim 1, wherein:

said cylindrical outer surface of said mandrel includes a smaller diameter portion and a larger diameter portion;

said packer element is received about said smaller diameter portion of said cylindrical outer surface of said mandrel;

said annular piston is a stepped piston having a smaller piston bore and a larger piston counterbore closely received about said smaller and larger diameter portions, respectively, of said cylindrical outer surface of said mandrel; and said annular differential pressure area of said piston is defined between said smaller piston bore and said larger piston counterbore.

3. The apparatus of claim 2, wherein:

said radially inner seal is received in a groove defined in said smaller piston bore and moves longitudinally with said piston; and said radially outer seal is received in a groove defined in said larger diameter portion of said cylindrical outer surface of said mandrel.

4. The apparatus of claim 1, further comprising:

a cylindrical outer sleeve concentrically received about said mandrel and fixedly attached to said mandrel, said sleeve having an inner sleeve bore spaced radially outward from said cylindrical outer surface of said mandrel and defining an annular space therebetween; and said annular piston being received in said annular space between said cylindrical outer surface of said mandrel and said sleeve bore.

5. The apparatus of claim 4, wherein:

said radially inner seal is received in a radially inner groove defined in said annular piston and moves longitudinally with said piston; and said radially outer seal is received in a radially outer groove defined in said annular piston and moves longitudinally with said piston.

6. The apparatus of claim 1, further comprising:

a frangible break-off plug having a hollow threaded portion received in said power port and having a break-off portion extending radially inward into said inner bore of said mandrel.

7. The apparatus of claim 1, further comprising:

locking means for locking said piston in an actuated position after said packer element is set.

8. The apparatus of claim 7, wherein said locking means comprises:

said piston having a radially inner groove partially defined by an annular tapered groove surface tapering radially inward toward said packer element; and a wedge lock ring received in said groove and having a tapered ring surface complementary to and engaging said tapered groove surface so that longitudinal expansion of said packer element after setting is opposed by said engaged tapered groove surface and tapered ring surface camming said wedge lock ring radially inward against said cylindrical outer surface of said mandrel.

9. The apparatus of claim 8, wherein:

said wedge lock ring has a serrated radially inner surface engaging said cylindrical outer surface of said mandrel.

10. The apparatus of claim 1 further comprising:

said piston having a longitudinal groove defined therein, said groove having first and second ends closer to and further away from said packer element, respectively; and a limit pin fixedly attached to said mandrel and extending into said longitudinal groove so that engagement of said limit pin with said second end of said longitudinal groove limits a setting motion of said piston.

11. The apparatus of claim 1 further comprising:

a plurality of externally accessible shear pins connecting said mandrel and said piston.

12. The apparatus of claim 1, further comprising:

a second shoe attached to said exterior of said mandrel on a side of said piston opposite from said packer element; and said fixed shoe and said second shoe each having outside diameters greater than an outside diameter of said piston.

13. A casing packer apparatus, comprising:

a mandrel having a mandrel exterior, a longitudinal mandrel bore defined therethrough, and a power port defined in said mandrel communicating said mandrel bore with said mandrel exterior;

a packer element concentrically received about said mandrel;

an annular piston concentrically received about said mandrel, said annular piston having a radially inner groove partially defined by an annular tapered groove surface tapered radially inwardly in a direction of actuating motion of said piston; and a wedge lock ring received in said groove and having a tapered ring surface complementary to and engaging said tapered groove surface so that longitudinal reverse movement of said piston is opposed by said engaged tapered groove surface and tapered ring surface camming said wedge lock ring radially inward against said mandrel exterior.

14. A casing packer apparatus, comprising:

a housing, including:

a longitudinal central housing bore defined through said housing;

a displacement chamber defined in said housing; and a power port defined in said housing and communicating said housing bore with said displacement chamber;

an inflatable packer element concentrically received about said housing and having a fluid inlet defined therein communicated with said displacement chamber; and a piston received in said displacement chamber and dividing said displacement chamber into a housing side chamber portion communicated with said power port and a packer side chamber portion communicated with said fluid inlet of said inflatable packer element, said piston being so arranged and constructed that fluid from said housing bore entering said housing side chamber portion through said power port moves said piston to displace fluid from said packer side chamber portion through said fluid inlet to inflate said inflatable packer element.

15. The apparatus of claim 14, wherein:

said displacement chamber is an annular chamber; and said piston is an annular piston.

16. The apparatus of claim 14, further comprising:

a supply fluid port defined in said housing and communicating said packer side chamber portion with an exterior of said housing so that well fluid from outside of said housing can enter said packer side chamber portion.

17. The apparatus of claim 16, further comprising:

a supply fluid check valve means operably associated with said supply fluid port, for allowing well fluid to flow from outside said housing into said packer side chamber portion, and for preventing fluid from flowing from said packer side chamber portion out through said supply fluid port.

18. The apparatus of claim 14, further comprising:

a fluid inlet check valve means, operably associated with said fluid inlet of said inflatable packer element, for allowing fluid to flow from said packer side chamber portion through said fluid inlet to inflate said inflatable packer element, and for preventing fluid from escaping from said inflatable packer element back out through said fluid inlet.

19. The apparatus of claim 14, wherein:

said packer side chamber portion is filled with an incompressible inflation fluid.

* * * * *